US008961772B2

(12) United States Patent
Buschur

(10) Patent No.: US 8,961,772 B2
(45) Date of Patent: Feb. 24, 2015

(54) METHOD AND APPARATUS FOR ELECTROPLATING METAL PARTS

(75) Inventor: John J. Buschur, Anna, OH (US)

(73) Assignee: JR Manufacturing, Inc., Fort Recovery, OH (US)

( * ) Notice: Subject to any disclaimer, the term of this patent is extended or adjusted under 35 U.S.C. 154(b) by 906 days.

(21) Appl. No.: 13/068,110

(22) Filed: May 3, 2011

(65) Prior Publication Data

US 2012/0279863 A1 Nov. 8, 2012

(51) Int. Cl.

| | |
|---|---|
| ***C25D 5/34*** | (2006.01) |
| ***C25D 21/12*** | (2006.01) |
| ***C25D 17/06*** | (2006.01) |
| *C25D 3/22* | (2006.01) |
| *C25D 17/10* | (2006.01) |

(52) U.S. Cl.

CPC ..... *C25D 21/12* (2013.01); *C25D 17/06* (2013.01); *C25D 3/22* (2013.01); *C25D 5/34* (2013.01); *C25D 17/10* (2013.01)

USPC ..... 205/205; 204/297.07

(58) Field of Classification Search

USPC ..... 205/205

See application file for complete search history.

(56) References Cited

U.S. PATENT DOCUMENTS

| | | | | |
|---|---|---|---|---|
| 2,299,618 | A * | 10/1942 | Finston | 134/70 |
| 2,724,690 | A * | 11/1955 | Solecki | 204/204 |
| 2,760,923 | A * | 8/1956 | Boguski | 205/217 |
| 4,184,927 | A | 1/1980 | Takahashi et al. | |
| 5,108,554 | A * | 4/1992 | Deters | 205/145 |
| 5,788,829 | A | 8/1998 | Joshi et al. | |
| 6,090,260 | A | 7/2000 | Inoue et al. | |
| 7,807,027 | B2 | 10/2010 | Yoshioka et al. | |
| 7,850,830 | B2 | 12/2010 | Richardson et al. | |
| 2002/0016067 | A1 * | 2/2002 | Yamagata et al. | 438/689 |

* cited by examiner

*Primary Examiner* — Bryan D. Ripa

(74) *Attorney, Agent, or Firm* — Jacox, Meckstroth & Jenkins

(57) ABSTRACT

A supply of metal parts are electroplated by progressively transferring the parts with a computer controlled robot into a series of open top tanks containing solutions. The tanks have submerged metal fixtures which temporarily support the parts, and each fixture in the electroplating tank is individually connected to a direct current power source through a corresponding timer switch controlled by the computer so that each part is plated for a precise time period independently of the time the part remains in the plating solution. Each fixture is coated with an insulation material and has a base with metal contact with a removable fixture member having limited metal line contact with the supporting part. A plurality of electroplating lines each include the above components, and common tanks in the lines receive an electroplating solution recirculated through a common filter and service tank where the solution is heated and controlled.

7 Claims, 4 Drawing Sheets

METHOD AND APPARATUS FOR ELECTROPLATING METAL PARTS

BACKGROUND OF THE INVENTION

This invention relates to the method and apparatus of electroplating metal parts such as, for example, U-shaped metal frames commonly used to support the adjustable headrests in an automobile or other motor vehicle. Examples of different methods and apparatus for electroplating parts are disclosed in U.S. Pat. No. 4,184,927, U.S. Pat. No. 5,788,829, U.S. Pat. No. 6,090,260, U.S. Pat. No. 7,807,027 and U.S. Pat. No. 7,850,830. In the electroplating of metal parts, it is common to use a rack plating system or a barrel plating system. In the rack system, multiple racks hang from or depend from some form of gantry system or conveyor, and multiple parts are usually supported by each rack. The racks with the supported parts are progressively moved by the conveyor through the plating process, and the racks and parts are successfully dipped into each plating solution. However, it is difficult to control the plating thickness on each part, with the result that there is usually a large variation of plating thickness on the part. DC current for plating is supplied from a rectifier to the parts through the gantry or conveyor system. When there is an accident or problem on the plating line, it is frequently necessary to remove all of the racks and parts from the conveyor, which may result in hours of down time of the plating line.

In barrel type electroplating, commonly the parts are placed into a barrel which is suspended from a gantry or conveyor, and the barrel takes the parts through the plating process by lowering the barrel into each plating solution while the barrel is rotated in the solution for a predetermined time. While the barrel plating system usually provides a more uniform plating thickness on the parts than does rack plated parts, there is no way to control the plating on one part from another part in the barrel.

SUMMARY OF THE INVENTION

The present invention is directed to an improved method and apparatus for electroplating a supply of metal or steel parts and includes arranging a series of open top tanks in a predetermined relation. The tanks contain different liquid solutions, and one of the tanks is an electroplating tank containing an electroplating solution. A plurality of spaced metal fixture units are supported within each tank for supporting a corresponding plurality of metal parts submerged within the solution, and each fixture unit in at least the electroplating solution is insulated by a plastics coating except in a limited area of metal-to-metal contact with the part supported by the fixture unit. Each of the fixture units in the electroplating tank is connected by a corresponding electrical connector to a source of direct current controlled through a corresponding timing switch for the fixture unit. A computer controlled robot is positioned adjacent the series of tanks and has a gripper for progressively and successfully transferring each part onto a corresponding supporting fixture unit within the series of tanks. The timing switch for each fixture unit in the electroplating solution is controlled by the computer for selecting the precise time each fixture unit and its supporting part receives direct current through the electroplating solution for obtaining plating of uniform thickness on the part.

The electroplating apparatus of the invention provides for individually plating each metal part on its own plating cycle within the electroplating solution and provides for easy and convenient changeover for plating different parts. The plating method and apparatus of the invention also eliminates all of the maintenance required for the rack and barrel plating systems, including the maintenance of a transferring gantry or conveyor system.

Other features and advantages of the invention will be apparent from the following description, the accompanying drawings and the appended claims.

DESCRIPTION OF THE ILLUSTRATED EMBODIMENTS

Figure 1:
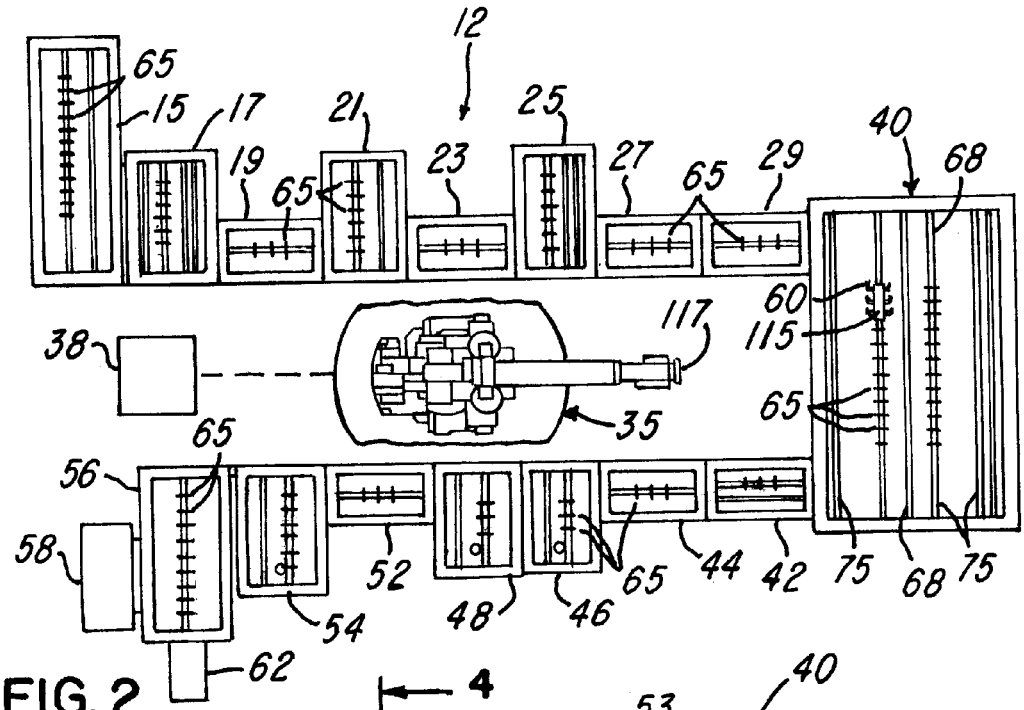
FIG. 1 is a diagrammatic plan view of an electroplating system or line constructed in accordance with the invention.

Referring to FIG. 1, an electroplating line 12 for a supply of metal or steel parts includes a series of open top tanks containing liquid solutions. The tanks include preplating tanks comprising, a cleaning tank 15 containing a cleaning solution where the parts are soaked for a number of minutes, an electrocleaning tank 17, a spray rinse tank 19, an etching tank 21 containing an acid pickle solution, another spray rinse tank 23, another electrocleaning tank 25, another spray rinse tank 27 and a sour acid tank 29 containing a zinc solution. The parts are progressively and successfully transferred through the above tanks by a computer controlled robot 35 such as, for example, a robot manufactured by Kabushiki Kaisha Yaskawa Denki of Fukuoka, Japan and sold under the trademark MOTOMAN, Model SK120. The robot 35 is controlled by a personal computer 38.

Following the sour acid tank 29, the parts are successively transferred by the robot 35 into an open top electroplating tank 40 containing electroplating solution such as an acid zinc plating solution. Following the electroplating tank 40, the parts are successively transferred by the robot 35 into a series of after plating or post treatment tanks, including a zinc drag out or removal tank 42, a spray rinse tank 44, a nitric bright dip tank 46, a clear chromate tank 48, a spray rinse tank 52, a hot water rinse tank 54 and a hot air drying tank 56. Heated air is supplied to the tank 56 from a heated air and fan unit 58 and an additional fan unit 62.

The specific solutions in all of the open top tanks of the electroplating line 12 are well known in the art of electroplating metal parts. Also, the range of time required for treatment in each of the solutions in the tanks is well known in the electroplating art. The metal parts illustrated in the drawings for describing the method and apparatus of the invention are a supply of generally U-shaped metal frames 60 used for supporting adjustable resilient head rests in motor vehicles. The frames 60 are commonly formed from solid steel rods or steel tubing and include a pair of formed legs 67 (FIG. 4) integrally connected by an intermediate straight head portion. The legs usually have axially spaced notches for vertical adjustment of the head rests.

Figure 2:
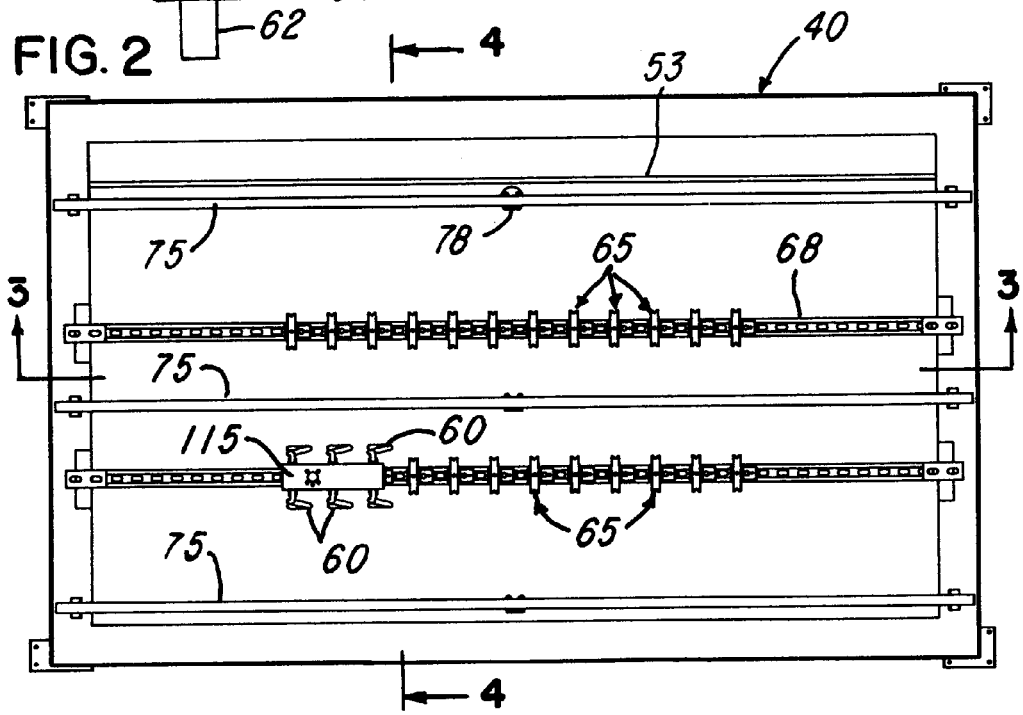
FIG. 2 is an enlarged plan view of the electroplating tank shown in FIG. 1.
Figure 3:
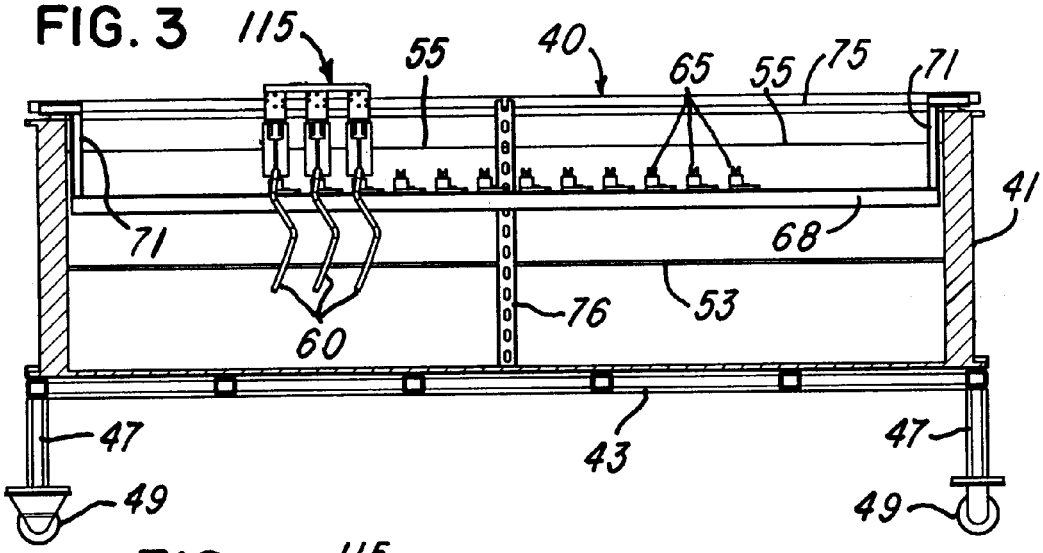
FIG. 3 is a longitudinally vertical section of the electroplating tank, taken generally on the line 3-3 of FIG. 2.
Figure 4:
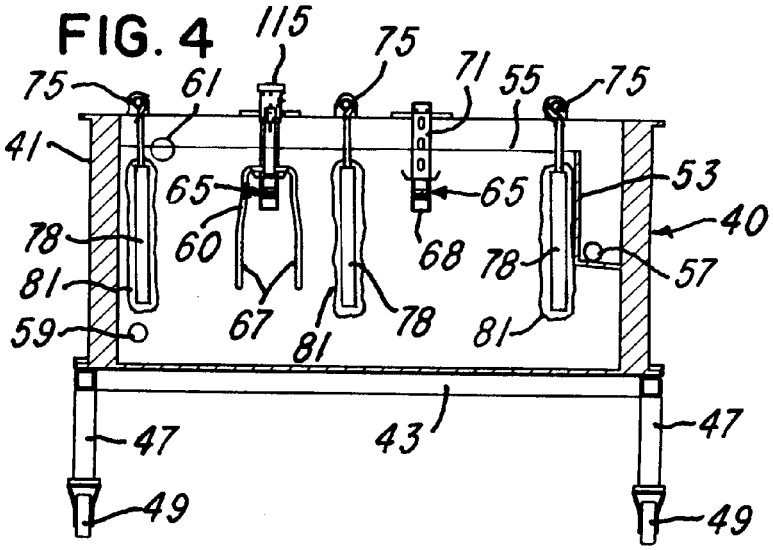
FIG. 4 is a lateral vertical section of the electroplating tank, taken generally on the line 4-4 of FIG. 2.

Referring to FIGS. 2-4, the electroplating tank 40 constructed in accordance with the invention, comprises a molded plastic container 41 supported by a rectangular tubular metal frame 43 having a set of corner legs 47 supported by a set of wheels 49, at least two of which are caster wheels. The tank 40 has an internal L-shaped weir 53 connected to a side wall, and the weir establishes the level of electroplating solution 55 (FIGS. 3 & 4). The tank 40 has a solution outlet port 57, an inlet port 59 and an overflow port 61. All of the tanks including the electroplating tank 40 contain a plurality of horizontally spaced separate fixture units 65 which are supported in the tank 40 submerged within the electroplating solution 55. The fixture units 65 are arranged in two rows with twelve units in each row, but more or less fixture units may be used. The fixture units 65 are supported by a horizontal channel member 68 having opposite end portions connected to inverted L-shaped brackets 71 secured to the top surface of the plastic tank container 41. As also shown in FIG. 4, the electroplating tank 40 also supports a set of horizontal copper support bars or rods 75 with each rod 75 having opposite end portions secured to the upper surface of the container 41 and having an intermediate vertical support post or channel 76. Each copper rod 75 supports a set of longitudinally spaced elongated solid metal bars 78 such as zinc bars each of which is enclosed within an elongated filter bag 81 and suspended in the solution 55.

Figure 6:
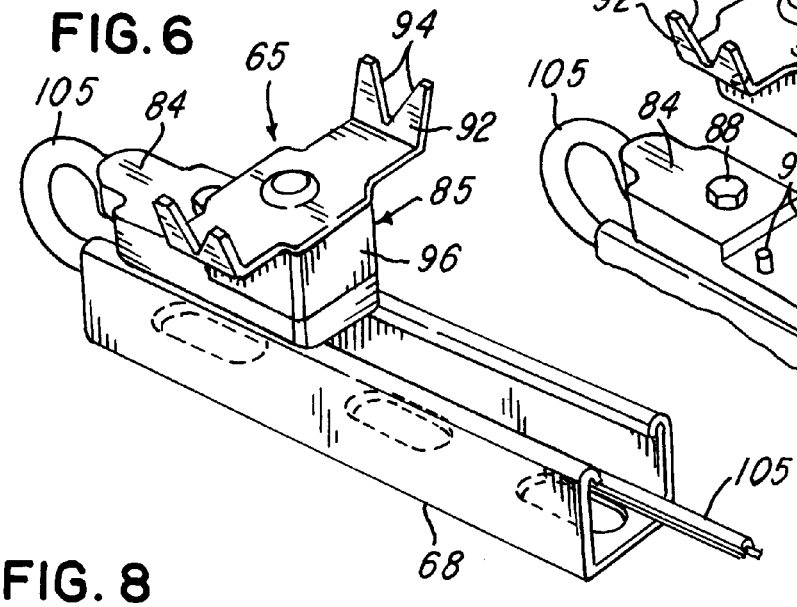
FIG. 6 is a fragmentary perspective view of a part support fixture unit and a fixture support channel shown in FIGS. 2-5.
Figure 7:
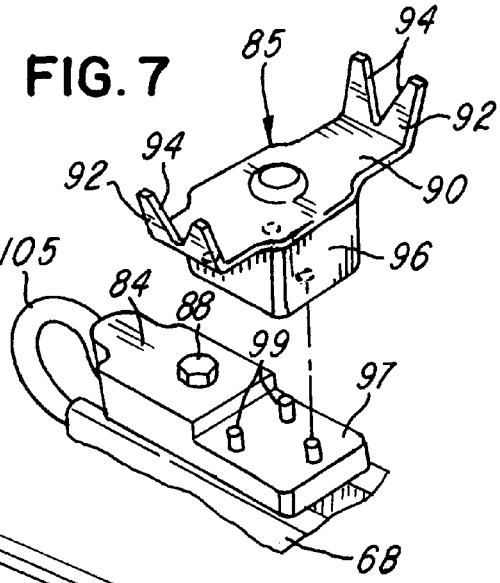
FIG. 7 is a fragmentary exploded view of the fixture unit shown in FIG. 6.
Figure 8:
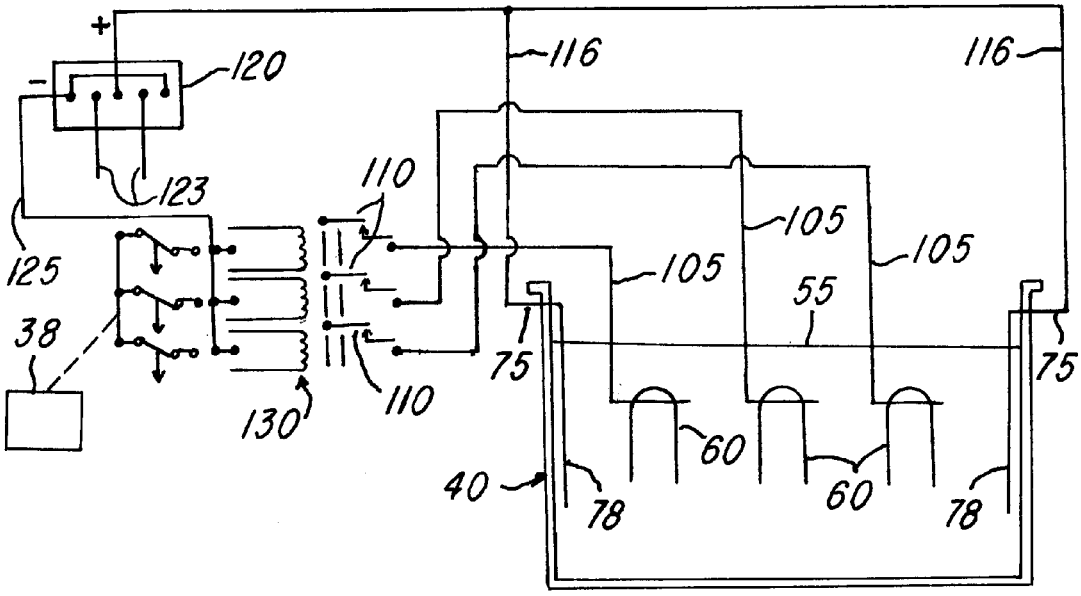
FIG. 8 is an electrical diagram for the electroplating operation in the electroplating tank in accordance with the invention.

Referring to FIGS. 6 & 7, each of the fixture units 65 includes a metal base member 84 and a removable metal part support member 85. The base member 84 is horizontally adjustable on the support member or channel 68 and is secured to the channel by a bolt 88 threaded into a plate (not shown) projecting under the top opposing hook portions of the channel 68. The support member 85 includes a formed sheet metal plate 90 having upwardly projecting opposite end portions 92 with notches formed by V-shaped edge surfaces 94 which support the metal part. The plate 90 is secured to a block 96 which seats on a flat mating surface 97 of the base member 84 and is located and retained by three locating studs or pins 99 which project upwardly into mating holes within the flat bottom surface of the block 96. Each of the metal fixture units 65 is electrically connected to an elongated flexible electrical conductor 105 each of which extends longitudinally through the support channel 68 to an end of the channel and over one of the support brackets 71 to a corresponding solenoid actuated relay switch 110 (FIG. 8). While only three fixture units 65 and corresponding conductors 105 are shown in FIG. 8, each of the twelve fixture units 65 supported by each of the channels 68 is connected by a corresponding conductor 105 to a corresponding relay switch 110.

Figure 9:
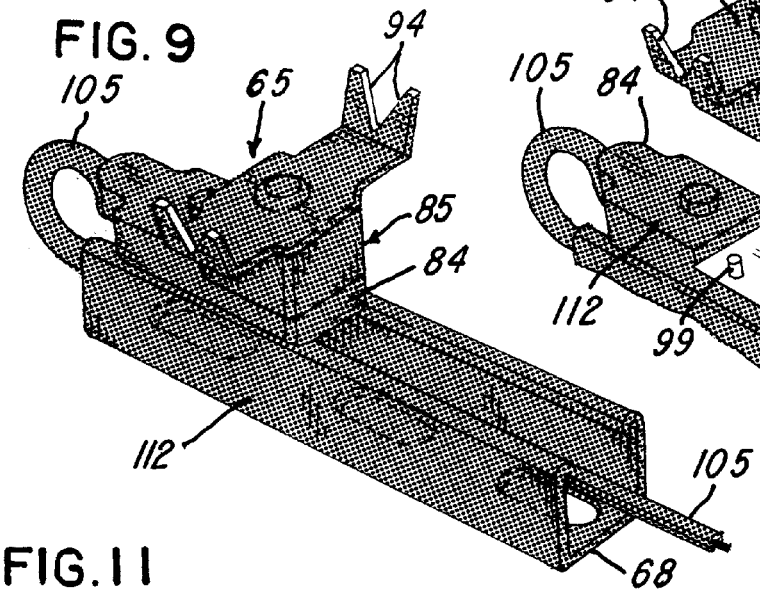
FIGS. 9 & 10 are perspective views similar to FIGS. 6 & 7 and illustrating the plastic insulation coating on the fixture components used in the electroplating tank and other tanks in accordance with the invention.
Figure 10:
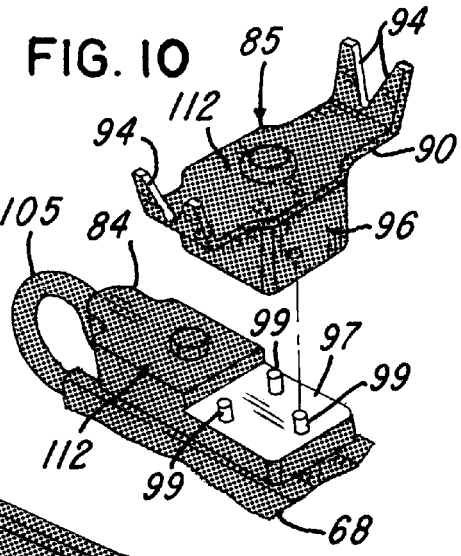

FIGS. 9 & 10 illustrate a portion of one of the support channels 68, a fixture unit 65 and the components of the fixture unit, all being coated with an electrical and chemical insulating material such as a plastisol or PVC material 112 except for the metal-to-metal contact surfaces 97 and 94 and the bottom surface on the block 96. Thus when the fixture member 85 is mounted on the base member 84, each of the fixture units 65 on each support channel 68 is completely insulated from the electroplating solution within the tank 40 except for the metal contact surfaces 94.

Figure 5:
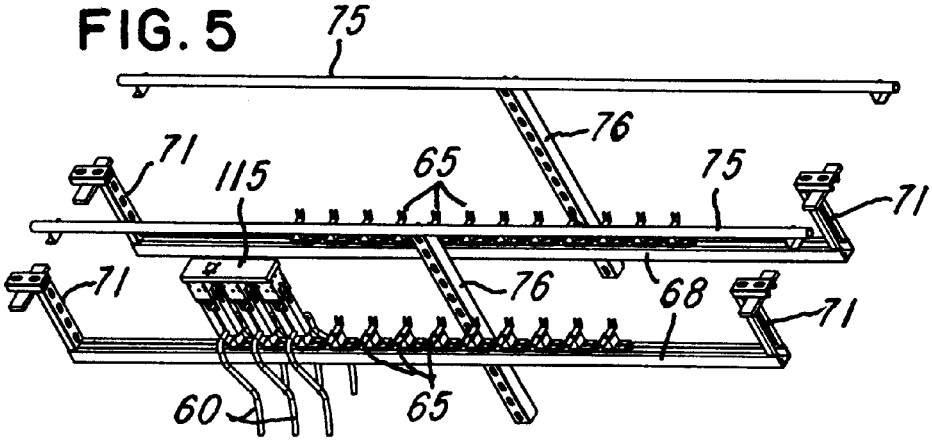
FIG. 5 is a perspective view of two cathode fixture assemblies and one anode support fixture used in the electroplating tank shown in FIGS. 2-4.

As shown in FIGS. 3-5, a power actuated and computer controlled gripper 115 is mounted on the head 117 of the robot 35 (FIG. 1) and is adapted to transport three of the metal parts or frames 60 successively and progressively through the open top tanks including the electroplating tank 40. The gripper 115 is also coated with the insulating material 112 and positions each of the frames 60 on the surfaces of a corresponding fixture unit 65 within each tank. When each part or frame 60 contacts the metal surfaces 94 on the support plate 90, electrical continuity is completed through the corresponding conductor 105 to the corresponding metal part or frame 60. Each fixture unit 65 and its corresponding electrical conductor 105 forms the cathode in the electroplating solution 55 for the corresponding part or frame 60 to be electroplated.

Referring to FIGS. 4 & 8, the zinc bars 78 are electrically connected to the copper support rods 75 which are electrically connected by conductors 116 so that the zinc bars 78 form the anodes in the electroplating solution. The conductors 116 connect the copper support rods 75 and the solid zinc bars 78 to the positive terminal of a rectifier 120 which receives 120 volt AC current through conductors 123 and converts the AC current into direct current. The rectifier 120 has a negative voltage output. As also shown in FIG. 8, the negative output of the rectifier 120 is connected by a conductor 125 to a series of timer switches 130 with each switch controlling the DC current from the conductor 125 to a corresponding conductor 105 extending to the fixture unit 65 supporting the corresponding part or frame 60. The timer switches 130 are controlled by the computer 38 which also controls the robot 35.

In operation of the electroplating line 12, the metal parts or frames 60 are progressively and successively advanced through the open top tanks 15, 17, 19, 21, 23, 25, 27 and 29 by the robot 35 which positions each part or frame 60 on its corresponding support fixture unit 65 within each tank. In tank 15, each part is cleaned by soaking in a cleaning solution, and then each part is transferred and electrocleaned in a solution within tank 17 where its corresponding support fixture unit 65 is connected by a conductor 105 to the DC current through a relay switch 110 and timer switch 130. Following the tank 17, each part is subjected to a fresh water spray rinse in tank 19 after which the part is etched by a acid pickling solution in tank 21. Each part is then spray rinsed in tank 23 after which the part is submerged in another electrocleaning solution in tank 25 where each supporting fixture unit 65 receives a timer controlled DC current through its corresponding conductor 105. In tank 27, each part is again spray rinsed with fresh water after which the part is submerged in a sour acid and zinc solution in tank 29.

From tank 29, each part 60 is transferred by the robot 35 onto its corresponding fixture unit 65 (FIGS. 6 & 9) where the part is submerged in the electroplating solution 55 as shown in FIGS. 1, 2 & 5. While the gripper 115 mounted on the head 117 of the robot 35 is illustrated for simultaneously transfers three parts or frames 60 through all of the open top tanks and onto the corresponding support fixture units 65 within the tanks, the robot gripper 115 may be constructed to transfer more or less than the three parts or frames 60. After each part or frame 60 is transferred into the electroplating solution 55 in the tank 40, the part receives a DC current through the corresponding timer controlled relay switch 110 for a predetermined time period, for example, five minutes. This individual electroplating of each part through its corresponding fixture unit 65 provides the plating of the part with a precise time period regardless of the total time the part remains in the electroplating solution 55. As a result, each part is electroplated with a substantially uniform optimum plating thickness.

After each part or frame 60 is electroplated in the tank 40, it is transferred by the robot 35 to its supporting fixture unit 65 in the tank 42 which contains a zinc dragout solution. Following the tank 42, each part is transferred to its corresponding fixture unit 65 within the spray rinse tank 44 and then the part is subjected to a nitric bright dip solution within the tank 46. Each part is then transferred onto a corresponding fixture unit within a clear chromate solution within the tank 48. Each part is then subjected to a fresh water spray rinse in tank 52 followed by being submerged in a hot water rinse solution within the tank 54. After the rinse in the tank 54, each part is transferred to the corresponding fixture unit 65 within the tank 56 where the part is dried by dry heated air circulated by the fan 58 and the additional fan unit 62. The parts or frames are then transferred by the robot 35 from the drying tank 56 and placed onto a shipping rack or container.

Figure 11:
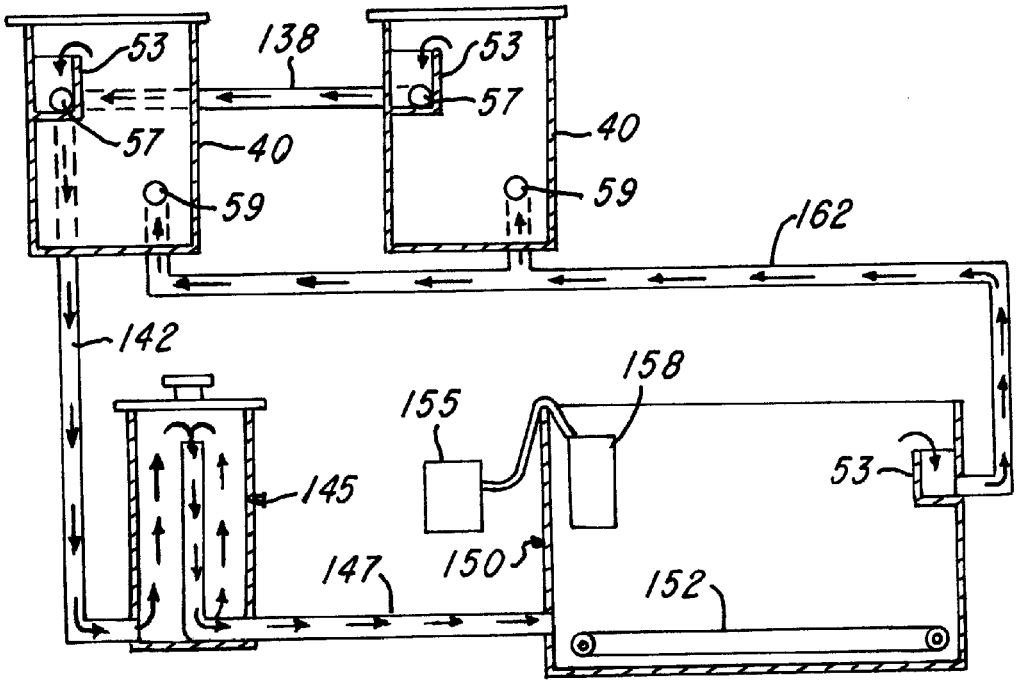
FIG. 11 is a diagrammatic illustration of a system for recirculating electroplating solution from a plurality of electroplating tanks in a plurality of the electroplating lines shown in FIG. 1.

Referring to FIG. 11, a plurality of electroplating lines 12, for example, ten lines, may be used for electroplating a large volume of metal parts such as the headrest frames 60. When multiple lines are used, the solutions in some of the common tanks may be processed and serviced in one common service tank which serves all of the common tanks in the multiple electroplating lines. As illustrated in FIG. 11, the electroplating solution in a plurality of two electroplating tanks 40 have outlets 57 behind the weirs 53 that are connected by a fluid conduit or solution line 138 to a line 142 which circulates the solution through a filter unit 145. The unit 145 removes impurities such as free zinc and iron from the electroplating solution, and the filtered solution is directed through a line 147 to a common service tank 150 which is sufficiently large to receive the weir overflow from all of the electroplating tanks 140 in the plurality of lines 12.

The electroplating solution in the service tank 150 is maintained at a selected constant temperature by a hot water heater coil 152, and titration of the solution is controlled by a conductivity controller 155 connected to a probe 158 submerged within the solution in the service tank 150. The controller 155 and probe 158 are commonly used in a single electroplating tank such as the tank 40 for maintaining the electroplating solution for desired conductivity. From the common service tank 150, the filtered processed electrochemical solution 55 is pumped back into all of the electroplating tanks 40 through a conduit or line 162 connected to the inlet 59 of each of the electroplating tanks 40 in the electroplating lines 12. The use of a common service tank may also be used for the cleaning and treatment solutions within other common tanks in a plurality of electroplating lines 12 such as common soak cleaning tanks 15 and common clear chromate tanks 48.

From the drawings and the above description, it is apparent that an electroplating method and apparatus constructed and used in accordance with the invention provides desirable features and advantages. For example, by individually electroplating each metal part in tank 40, each part may be set up for its own plating cycle so that full control may be obtained for plating each part. The apparatus of the invention also eliminates the use of any racks and a conveyor for transporting the racks, the investment in the racks and conveyor as well as the maintenance of the racks and conveyor. The apparatus also provides for easy changeover for handling different parts simply by interchanging the fixture support members 85 to accommodate the different part such as a different metal frame for a motor vehicle headrest. The portable tanks and computer controlled robot further provide for conveniently changing the layout of the tanks for selecting the optimum arrangement of the tanks according to available floor space for the tanks. When multiple or a plurality of electroplating lines 12 are desired, as referred to in FIG. 11, the use of a single large service tank 150 for treating the solutions in all common tanks of the lines provides for simplified titration of the solution within the common tanks and for heating of the solution so that a uniform solution is used throughout all of the electroplating lines within common tanks. As another important advantage, the individual plating of each part in the electroplating solution by use of a separate fixture unit for each part provides for precise control for plating each part to obtain uniform plating on each part with the result of an improved part appearance.

While the method and form of apparatus herein described constitute a preferred embodiment of the invention, it is to be understood that the invention is not limited to this precise method and form of apparatus described, and that changes made therein without departing from the scope and spirit of the invention as defined in the appended claims.

What is claimed is:

1. A method of electroplating a supply of metal parts, comprising the steps of arranging a series of open top tanks in predetermined relation with the tanks containing different liquid solutions and with one of the tanks being an electroplating tank containing an electroplating solution, positioning in each of the tanks a support member supporting a plurality of metal fixture units for supporting a plurality of the metal parts submerged within the solution within the tank, with the fixture units in each tank being accessible from the top of the tank, forming each fixture unit in the electroplating solution with a limited area of metal-to-metal contact with the metal part supported by the fixture unit in the electroplating solution, precoating each fixture unit within the electroplating solution with an insulation material except in the limited area of metal-to-metal contact with the part supported by the fixture unit, connecting each of the metal fixture units in the electroplating tank to a corresponding electrical conductor extending on the support member to a source of direct current controlled through a corresponding timer switch for the fixture unit, positioning a computer controlled robot adjacent the series of tanks with the robot having a gripper for progressively and successively transferring each part onto the supporting fixture units as the part is advanced the series of tanks, and controlling each timer switch for each fixture unit in the electroplating solution to select the precise time each fixture unit and its supporting part receives direct current within the electroplating solution in the electroplating tank for individually plating each part to obtain on each part a plating of substantially uniform thickness and independently of the total time the part remains in the electroplating solution.

2. A method as defined in claim 1 wherein each of the fixture units is coated with a plastics material resistant to the electroplating solution and to insulate the fixture unit from the direct current supplied to the part through the limited area of metal-to-metal contact with the part.

3. A method as defined in claim 1 including the steps of forming all of the tanks of a rigid plastics material and supporting each tank with a frame mounted on a set of wheels comprising caster wheels.

4. A method as defined in claim 1 including the steps of forming each of the fixture units with a metal base member supporting a removable metal fixture member having the limited area of contact with the part, and providing metal-to-metal contact between the base member and the fixture member to provide for interchanging fixture members for supporting and electroplating different metal parts.

5. A method as defined in claim 1 wherein the series of open top tanks, metal fixture units and robot form am electroplating line, and including the steps of forming a plurality of the electroplating lines, and connecting the electroplating tank in each electroplating line with a recirculating solution line connected to a common service tank where the electroplating solution is heated and uniformly serviced for all of the electroplating tanks.

6. A method as defined in claim 1 wherein said series of open top tanks include at least one pretreatment tank containing a cleaning solution, and including the step of connecting each of the metal fixture units in the pretreatment tank to a corresponding electrical conductor extending to a source of direct current.

7. A method as defined in claim 1 wherein the supply of metal parts comprise generally U-shaped metal frames for supporting head rests in motor vehicles.

* * * * *